US005832980A

United States Patent [19]

Cianciolo

[11] Patent Number: 5,832,980

[45] Date of Patent: Nov. 10, 1998

[54] FLOATING PIVOT SLIDING AND SWINGING PANEL CONSTRUCTION FOR DOORS AND THE LIKE

[75] Inventor: John S. Cianciolo, Waukesha, Wis.

[73] Assignee: NT Dor-O-Matic Inc., Chicago, Ill.

[21] Appl. No.: 785,651

[22] Filed: Jan. 17, 1997

[51] Int. Cl.[6] ..... E05D 15/06

[52] U.S. Cl. ..... 160/197; 160/211

[58] Field of Search ..... 160/197, 202, 160/211, 210, 201

[56] References Cited

U.S. PATENT DOCUMENTS

| | | | |
|---|---|---|---|
| 552,879 | 1/1896 | Muchmore . | |
| 782,139 | 2/1905 | Jones . | |
| 1,472,457 | 10/1923 | Brown . | |
| 2,530,263 | 11/1950 | Peremi et al. . | |
| 2,576,854 | 11/1951 | Peremi et al. . | |
| 2,581,783 | 1/1952 | Bates . | |
| 3,136,538 | 6/1964 | Dimmitt et al. . | |
| 3,300,897 | 1/1967 | Wikkerink . | |
| 3,318,047 | 5/1967 | Carson . | |
| 3,327,428 | 6/1967 | Horton et al. . | |
| 3,445,963 | 5/1969 | Gilbert et al. . | |
| 3,464,159 | 9/1969 | Hewitt et al. . | |
| 3,466,805 | 9/1969 | Muessel . | |
| 3,491,483 | 1/1970 | Miller . | |
| 3,579,909 | 5/1971 | Schacht . | |
| 3,605,339 | 9/1971 | Catlett et al. . | |
| 3,675,370 | 7/1972 | Catlett . | |
| 3,750,334 | 8/1973 | Slaybaugh . | |
| 3,750,737 | 8/1973 | Woodward | 160/202 X |
| 3,793,773 | 2/1974 | Sheckells . | |
| 4,058,932 | 11/1977 | Peterson et al. . | |
| 4,078,333 | 3/1978 | Lussier . | |
| 4,103,945 | 8/1978 | Turman . | |
| 4,164,095 | 8/1979 | Musacchia . | |
| 4,286,411 | 9/1981 | Wikkerink et al. . | |
| 4,305,227 | 12/1981 | Georgelin . | |
| 4,414,777 | 11/1983 | Masacchia . | |
| 4,438,594 | 3/1984 | Bunzl . | |
| 4,571,885 | 2/1986 | Uemura et al. . | |
| 4,619,074 | 10/1986 | Leung et al. . | |
| 4,878,530 | 11/1989 | Jean | 160/211 |
| 5,036,620 | 8/1991 | Beran et al. . | |
| 5,242,005 | 9/1993 | Borgardt . | |
| 5,309,676 | 5/1994 | Appelmann et al. . | |
| 5,369,912 | 12/1994 | Ginzel et al. . | |
| 5,392,834 | 2/1995 | Borgardt . | |
| 5,417,272 | 5/1995 | Marlowe et al. | 160/211 X |

OTHER PUBLICATIONS 3 sheets of technical drawings of Stanley Model 7000TL Door.

*Primary Examiner*—David M. Purol

*Attorney, Agent, or Firm*—Brinks Hofer Gilson & Lione; Michael H. Minns

[57] ABSTRACT

A swinging slide panel construction has panels which can slide relative to one another to open half of an opening, such as a doorway, and then swing together in a break-away mode for full access to the opening. One panel, which is pivotally fixed in the opening, has a support thereon which engages with a track on the other panel to support the same when the two panels are overlapped and swung open. A floating pivot assembly further engages the panels along the bottoms thereof, with the pivot assembly being entirely carried by the panels.

18 Claims, 4 Drawing Sheets

FLOATING PIVOT SLIDING AND SWINGING PANEL CONSTRUCTION FOR DOORS AND THE LIKE

This application claims the benefit under 35 U.S.C. §119(e) of the U.S. provisional application No. 60/011,812, filed Feb. 16, 1996.

BACKGROUND OF THE INVENTION

This invention generally relates to door and window systems which are designed to have panels which slide relative to one another, and more particularly to such systems which further include swinging movement of the panels on a pivot.

The construction of door panels having a sliding swinging ability is known in the art. One example is U.S. Pat. No. 3,750,334, issued to Slaybaugh, assigned to the assignee of the present invention. Slaybaugh discloses a support assembly for a sliding swinging door. The door is supported by this single support assembly, which also acts as a pivot for swinging movement of the door. This provides a simple yet effective means to support a door, from an upper corner only, to accommodate the sliding and swinging movement of the door.

Another example of a swinging sliding door structure is U.S. Pat. No. 4,619,074, issued to Leung et al. Leung et al. disclose a convertible door system wherein the door comprises one or more pair of panels. Each pair of panels includes a swinging panel and a sliding panel. The sliding panel can be moved from a closed position, where it is end-to-end with the swinging panel, to a semi-open position, where it is juxtaposed face-to-face with the swinging panel. The sliding panel slides on a track located at the bottom and at the top of the panel. After the panels are in the semi-open position, both panels may then be swung as a unit to fully open the door structure. The swinging panel rotates around pivots which are mounted in the door frame. The track on which the sliding panel slides is comprised of two sections, with one section being mounted on pivots in the door frame. Thus, when the sliding panel is positioned in this section, i.e., when it is in the semi-open position, it swings on pivots mounted in the door frame. Here, a "trip" hazard is present because the sliding panel slides in a track located at the bottom of the door, i.e., on the floor.

There are other swinging sliding door constructions known in the art similar to Leung et al. above, but which include mounting the track on which the sliding panel slides on a pivot located on the floor, instead of mounting the pivot in the door frame. To engage in swinging movement, the sliding panel would have to "ride up" onto the pivot. Here, again, a trip hazard is present because the pivot is located on the floor.

Another example of a swinging sliding door structure is U.S. Pat. No. 4,438,594, issued to Bunzl. Bunzl discloses a balanced door structure having at least one sliding door, which slides in a track located at the bottom of the door and is suspended from an upper support rail. The door is comprised of a door frame and a swing panel. Hinge means allow the swing panel to disengage from the door frame. The swing panel can then swing out with respect to the door frame. Here, again, a trip hazard is present because the sliding door slides in a track located at the bottom of the door, i.e., on the floor.

Another example of a swinging sliding door structure is U.S. Pat. No. 3,464,159, issued to Hewitt et al. Hewitt et al. discloses a swinging slide panel construction wherein the sliding panel slides along a track located at the top of the panel. On one side of the panel, a suspension bar and pivot block is vertically mounted. The panel is allowed to swing about the suspension bar and a pivot pin located at a bottom comer of the panel.

SUMMARY OF THE INVENTION

It is an object of the present invention to provide a closure structure having a pair of panels, which combines a sliding panel structure with a pivoting ability in a manner yielding substantially full and unobstructed access across the width of an opening (e.g., a doorway) when the panels are so pivoted, without the need of a track or other weight-transfer element on the floor for a sliding panel, while also allowing conventional sliding of the panels.

It is yet another object of the present invention to have a pivot concealed in the panels themselves, thereby avoiding the trip hazard associated with prior art swinging sliding door constructions which include mounting a pivot on the floor.

Further, the present invention has the primary track for the sliding movement of the panels positioned at the top of the panels, i.e., the top of the opening. Here again, the trip hazard associated with having track means on the floor itself is eliminated.

The present invention may be utilized in any opening or doorway. It is particularly advantageous where a trip hazard needs to be avoided, such as in a hospital intensive care unit.

Briefly, the present invention in one form is comprised of at least first and second panels. The second panel is allowed to slide relative to a first panel via a track, and at least one wheel assembly. The track means is positioned at the top of the panels in a header, which is mounted in the top of the opening. A wheel assembly is mounted to a carrier bar, which engages with a mounting bar, which is mounted to the top of the second panel. The wheel assembly slides in the track to allow the second panel to slide relative to the first panel. The second panel can slide from a fully closed position, wherein the panels are fully extended relative to one another, to a slid-open position, wherein the panels are substantially overlapped.

In the foregoing embodiment, the first panel is pivotally fixed at the top and bottom of the opening at one side of the opening. The second panel has a torsion bar mounted within one side thereof. In the swinging mode of operation of the panels (i.e., the panels swinging as a unit), the first panel will swing about the top and bottom pivots fixed at one side of the opening, while the second panel will swing with the first panel about the torsion bar and a floating pivot assembly, discussed in more detail below.

The second panel is first maintained in the opening, and thus restricted from swinging out with the first panel before it substantially overlaps the first panel, by the mounting bar; the mounting bar is mounted to the top of the second panel, and the carrier bar is movably mounted in a header. In particular, the mounting bar and the carrier bar engage through an overlapping flange interconnection along the length of both bars. When the second panel is rotated so as to disengage the mounting bar from the carrier bar, the mounting bar swings with the panel, while the carrier bar remains in a channel of the header.

A stop bar is mounted along a section of the header such that when the panels are fully extended relative to one another, the mounting bar abuts the stop bar to prevent the two panels from swinging together. When the panels are substantially overlapped, the stop bar no longer abuts the mounting bar, and the second panel is no longer restricted from swinging out.

The first panel is further maintained in the opening and thus restricted from swinging out by a bolt assembly positioned in the first panel. Once this bolt assembly is released, the panels may pivot together through the floating pivot assembly.

The floating pivot assembly is positioned inside, or concealed within, the panels. A pivot mounting is mounted to a section of the bottom of the second panel, with a channel formed therein. A guide is mounted within this channel and is adapted to slide within this channel. An arm extends from this guide, with a pivot member mounted thereon. The pivot member is received within a second channel formed along the bottom of the first panel to slide therein.

Preferably, the pivot mounting is comprised of a mounting block and a slide channel unit. Thus, the mounting block is mounted to a section of the bottom of the second panel, and the slide channel unit is mounted to the mounting block. The slide channel unit is comprised of a channel plate, with the channel formed therein. Preferably, the guide and the arm are comprised of a mounting plate and an L-shaped base plate. The mounting plate is slidably received within the channel through mounting studs, and the L-shaped base plate is mounted to the mounting plate. The L-shaped plate has the pivot member mounted thereon, which can be a wheel or roller. Thus, the wheel slides within the channel formed in the bottom of the first panel as the second panel slides relative to the first panel.

The wheel also forms the bottom pivot point for the second panel when the panels are in the swinging mode of operation. As the panels start their swinging movement, the second panel pivots about the wheel positioned within the first panel. Because the wheel can slide in the track formed in the bottom of the first panel, the second panel swings from a beginning position where it overlaps the first panel to an ending position where it is overlapped by the first panel.

A support member is positioned on the upper side of the first panel facing the second panel. Preferably, this support member is a guide roller. A guide bar is positioned along the upper side of the second panel facing the first panel. The guide roller is slidably received within a channel formed in the guide bar. Once the second panel begins its swinging mode of operation, the weight of this panel is transferred via the guide bar to the guide roller of the first panel.

Thus, door sag of the second panel is prevented because the weight of the second panel is distributed to the first panel during the swinging mode of operation of the panels. In addition, the guide bar itself is wide enough to prevent "finger pinch" in the space between the overlapped panels during the sliding and swinging movements of the panels. Because the floating pivot assembly is concealed in the panels, the need for a weight transfer pivot mounted to the floor is eliminated, along with the attendant trip hazard of such a pivot. Lastly, because the floating pivot assembly is concealed in the panels, and thus the second panel slides on a track located at the top of the opening and on a track located within the bottom of the first panel, the need for a track mounted to the floor is eliminated, along with the attendant trip hazard of such a track.

Other features and advantages of the present invention will become apparent from the detailed description that follows taken in conjunction with the drawings, described below.

DETAILED DESCRIPTION OF A PREFERRED EMBODIMENT

Figure 1:
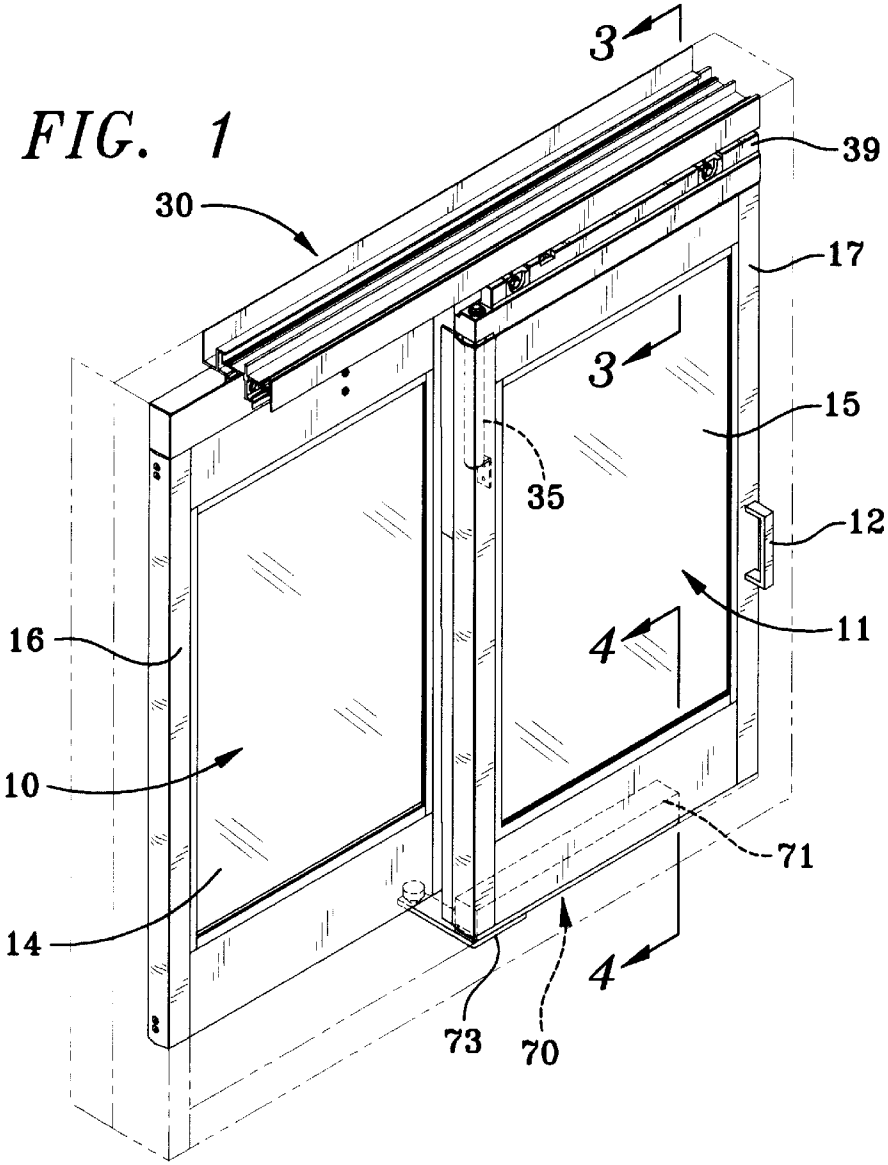
FIG. 1 is a perspective view of a door structure made in accordance with the teachings of the invention.
Figure 2:
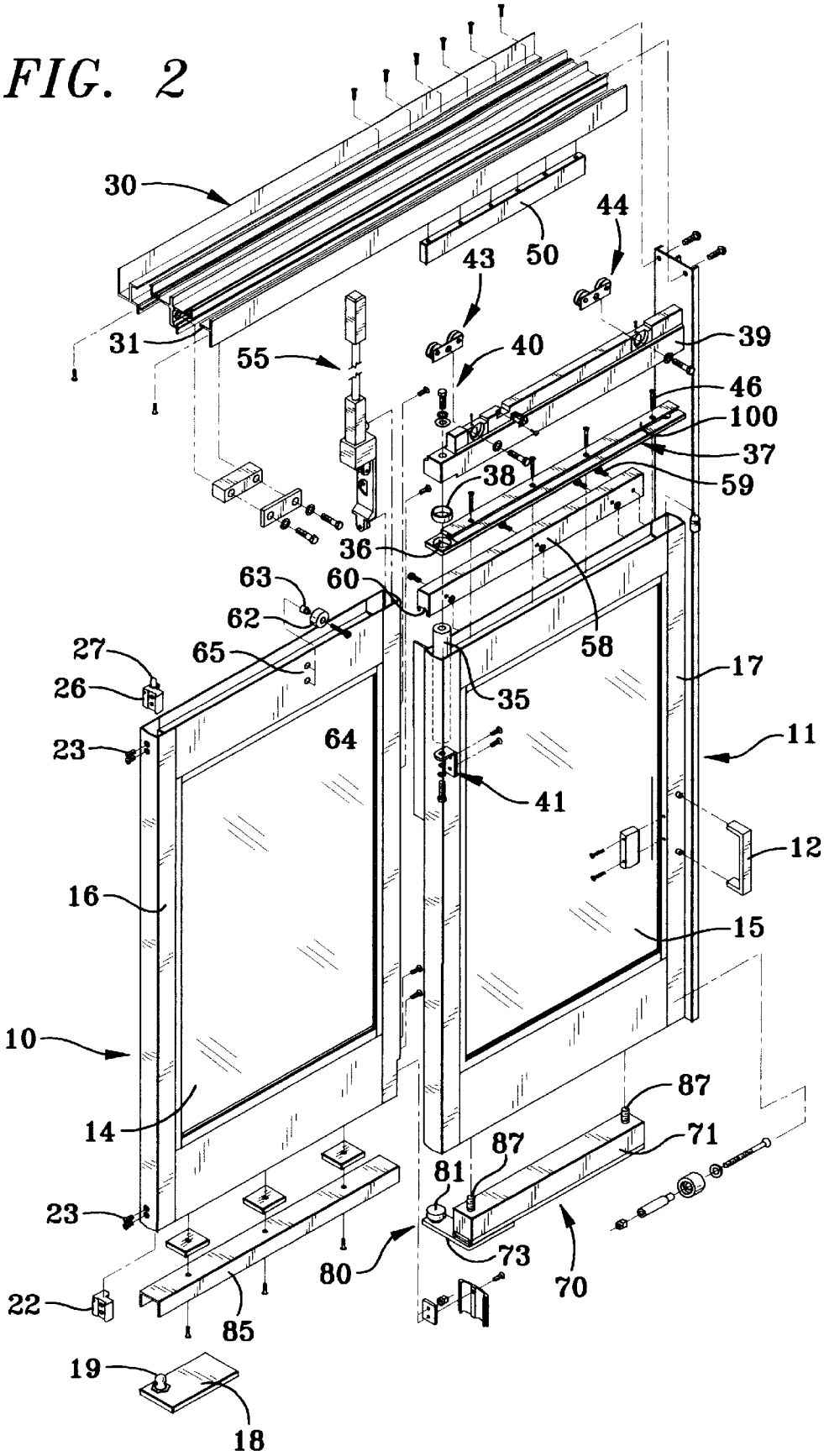
FIG. 2 is an exploded perspective view of the door structure of FIG. 1.

Turning now to the drawings, FIGS. 1 and 2 illustrate a left panel 10 and a right panel 11 (left and right are referenced herein relative to the viewer). Panel 11 slides relative to panel 10, as will be further discussed below. The panels 10, 11 may be comprised of any material suited for a door panel, such as wood, glass and the like. Each panel 10, 11 is comprised of a single pane of glass 14, 15, respectively, or a double pane of glass. Each pane of glass 14, 15 is mounted and glazed in standard fashion within the left and right frames 16, 17, respectively. Each frame 16, 17 can be manufactured through any conventional process for constructing door frames. In one embodiment, the frames 16, 17 are comprised of conventional extruded aluminum interlocking sections using a rod-bolted construction. A door handle 12 is provided, which can also be a recessed handle on both sides.

The left panel 10 includes means for mounting the panel in the opening for pivoting the first panel open and closed in the swinging mode of operation. In particular, the left panel 10 is pivotally fixed to the floor on a pivot base plate 18 having a base pivot pin 19. This base pivot pin 19 is received in a bottom pivot assembly 22 fixed within the left-hand bottom side of the left frame 16, as by screws 23 or any other conventional attachment means. At the upper left-hand side of the left frame 16 is a similar top pivot assembly 26, likewise fixed in place with screws 23 or any other conventional attachment means. Top pivot assembly 26 has an integral pivot pin 27 which is received in an appropriate receptacle (not shown) in a header assembly 30. The header assembly 30 is mounted within the top of the door opening. In a preferred embodiment, the header assembly 30 is made of extruded aluminum stock.

The right panel 11 has a torsion bar 35 mounted within the left-hand side of its frame 17. The upper end of the torsion bar 35 extends through a hole 36 in a mounting bar 37, through a carrier collar 38 and into a carrier bar 39. The torsion bar 35 is fixed to the carrier bar 39 by a hex screw assembly 40 or any other conventional attachment means. A bracket assembly 41 attaches the lower end of the torsion bar 35 within the frame 17.

The carrier bar 39 has left and right wheel assemblies 43, 44, respectively, mounted thereon. A channel 31 is formed in the header 30. These wheel assemblies 43, 44 slide in the channel 31 to allow the right panel 11 to slide relative to the left panel 10 (see FIG. 3)

The mounting bar 37 is fixed, as by screws 46, to the top of the right frame 17. Means for releasably engaging the panels 10, 11 for sliding movement and releasably disengaging the panels 10, 11 when in the swinging mode of operation comprises the mounting bar 37 and the carrier bar 39. The mounting bar 37 and the carrier bar 39 engage through an overlapping flange interconnection 100 along the length of the bars 37, 39. When the mounting bar 37 releasably disengages from the carrier bar 39, as further described below, the panels can then swing out. This provides a break-away feature. Conceivably, the right panel 11 could be adapted to rotate relative to the panel 10 while in the fully-extended condition, but that is not how the present embodiment is adapted.

In addition to the interconnection between the mounting bar 37 and the carrier bar 39, other features are employed in the present invention to maintain the panels in the opening, and thus to prevent the joint swinging mode of operation of panels 10, 11 until the panel 11 is slid to substantially overlap the panel 10. Substantial overlap occurs when the panel 11 is slid into its leftmost position. In one embodiment, substantial overlap occurs when the right panel 11 extends about one inch farther than the left panel 10.

A first feature is a stop bar 50 mounted along a section of the header 30. The length of the stop bar 50 along the header 30 is such that the right panel 11 can pivot with panel 10 only after the panel 11 has slid past, or cleared, the stop bar 50. In particular, the mounting bar 37 of the panel 11 abuts the stop bar 50 until the right panel 11 is slid to its leftmost position. Another feature is a standard flush bolt assembly 55 mounted within the right-hand side of the top of the left panel 16. The bolt assembly 55 prevents swinging movement of the panel 10 until it is released.

Mounted along the upper side of right frame 17 facing the left panel 10 is a guide bar 58, which is fixed to the frame by cap screws 59. The guide bar 58 has a downwardly open channel 60 formed therein. A support member is mounted to the upper right-hand side of left frame 16 facing the right panel 11. In one embodiment, the support member is a guide wheel or roller 62 (see FIG. 3). The roller 62 is mounted on a shaft 63 and truss head screw 64 assembly (see FIG. 2). The roller 62 is received in the channel 60 of the guide bar 58. When the panel 11 begins to swing, the weight of this panel is transferred to the roller 62 via the guide bar 58. Thus, the weight of panel 11 is transferred to the panel 11 as the now-overlapped panels 10, 11 rotate in swinging movement. The guide bar 58 is wide enough to avoid "finger pinch" during the sliding and swinging movement of the panels. A stop block 65 is located above the roller 62 to prevent derailing of the door.

When the right panel 11 is moved to its leftmost position, i.e., such that the mounting bar 37 no longer abuts the stop bar 50, and when the flush bolt 55 is released, the panels are now ready to engage in the swinging mode of operation, utilizing the floating pivot assembly 70 of the present invention. FIGS. 6, 7, 8 and 9 illustrate the floating pivot assembly 70, which is mounted to the bottom of the right frame 17 and is received within the bottom of the left frame 16. In one embodiment, this assembly 70 is generally comprised of a pivot mounting 75, a channel 76, a guide 88, an arm 89 extending from the guide 88, and a pivot member 81. The pivot member 81 is slidably received within a channel 85 (FIG. 2) formed along the bottom of the left frame 16.

In a preferred embodiment, the pivot mounting is comprised of a mounting block 71 and a slide channel unit 72. The guide 88 and the arm 89 extending from the guide 88 are comprised of a mounting plate 78 and an L-shaped base plate 73 which is fixed to the mounting plate 78.

Figure 9:
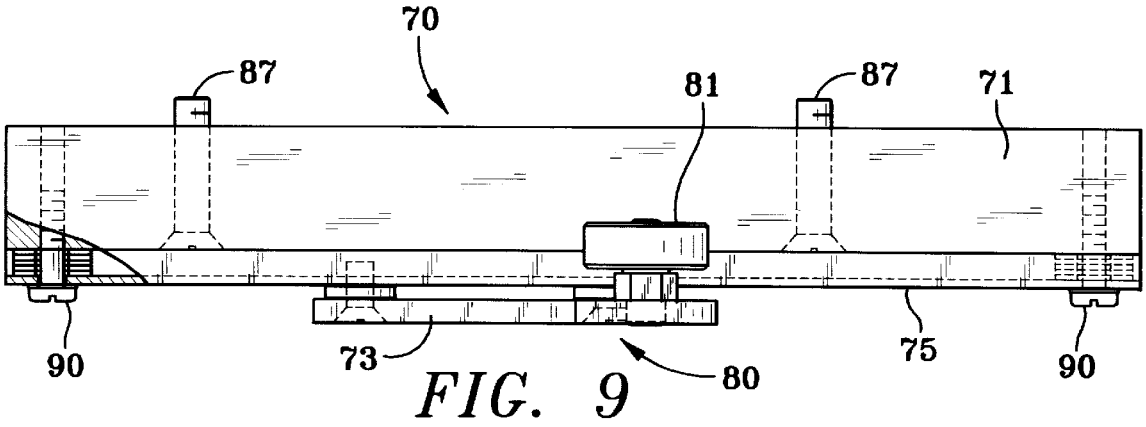
FIG. 9 is a side elevational view of the pivot assembly of FIG. 8.

As illustrated in FIGS. 2 and 9, the mounting block 71 is mounted to the bottom of the right frame 17 by any conventional means, such as by screws 87 or bolts. The slide channel unit 72 is mounted to the bottom of mounting block 71 by screws 90.

Figure 6:
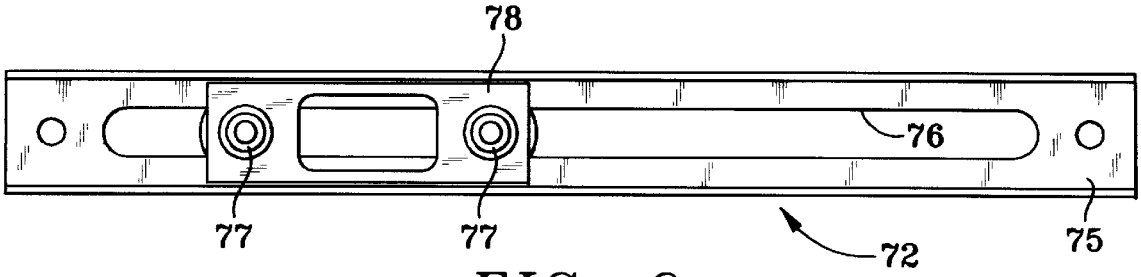
FIG. 6 is an enlarged plan view of the slide channel assembly.
Figure 7:
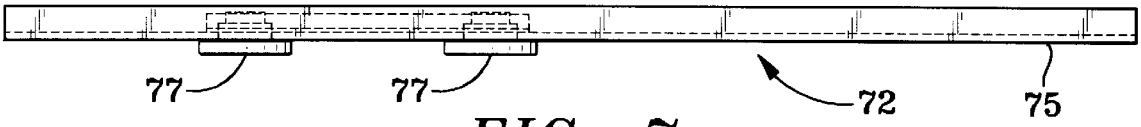
FIG. 7 is a side elevational view of the slide channel assembly of FIG. 6.

The slide channel unit 72 is illustrated in FIGS. 6 and 7. The slide channel unit 72 is comprised of a channel plate 75, with a channel 76 formed therein. A mounting plate 78 is received in the channel 76 by mounting studs 77. The mounting plate 78 slides within the channel 76.

Figure 8:
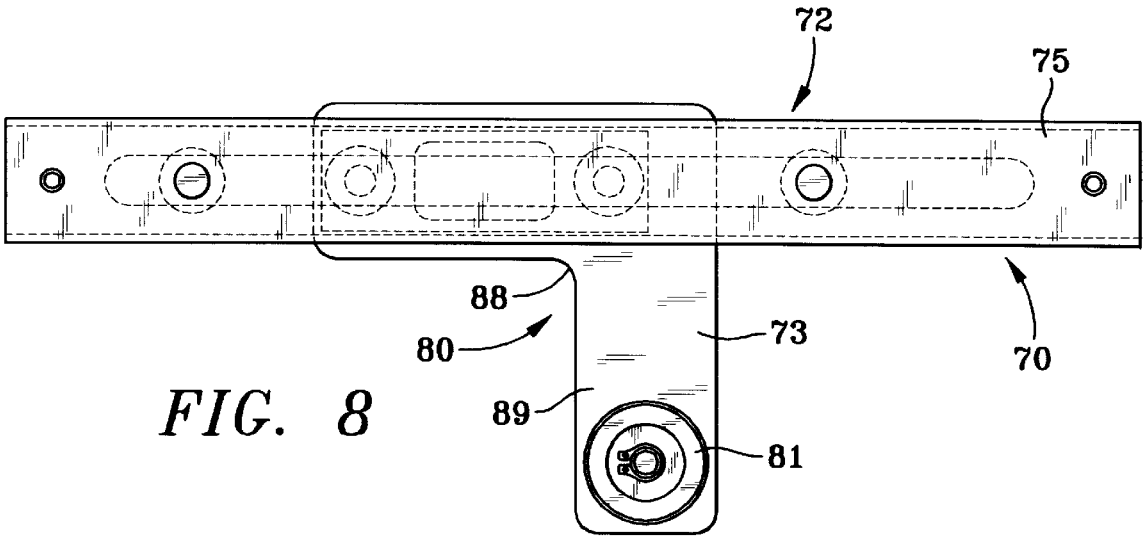
FIG. 8 is a plan view of the floating pivot assembly.

Turning now to FIG. 8, an L-shaped pivot plate 73 is fixed to the mounting plate 78. A pivot member 81 is mounted on the L-shaped base plate 73. The pivot member 81 has a rotatable pivot wheel assembly 80 with a wheel 81.

Figure 3:
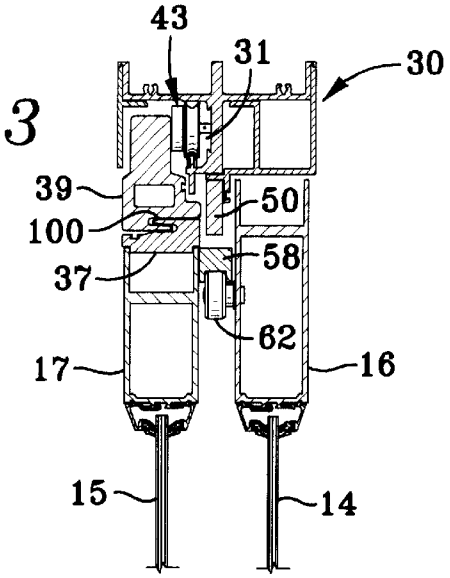
FIG. 3 is a cross-sectional view taken along line 3—3 of FIG. 1.
Figure 4:
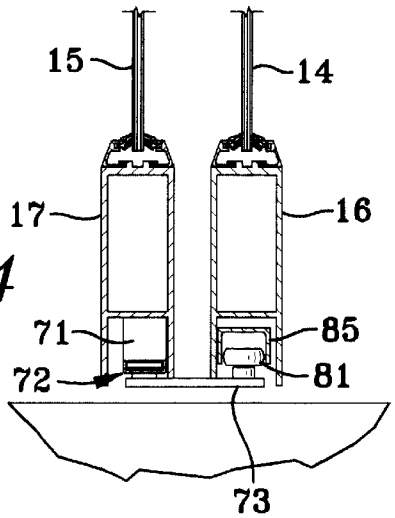
FIG. 4 is a cross-sectional view taken along line 4—4 of FIG. 1.
Figure 5A:
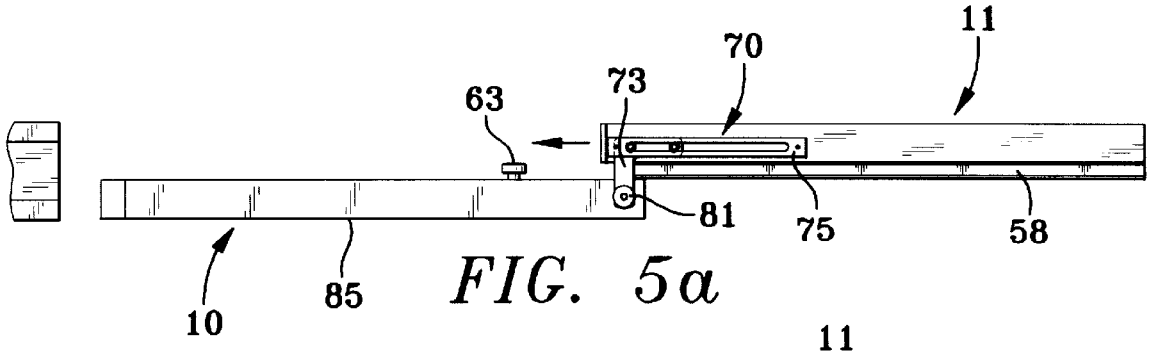
FIG. 5*a* is a schematic view of the bottom of the panels of FIG. 1 in the full-closed position (full extension)
Figure 5B:
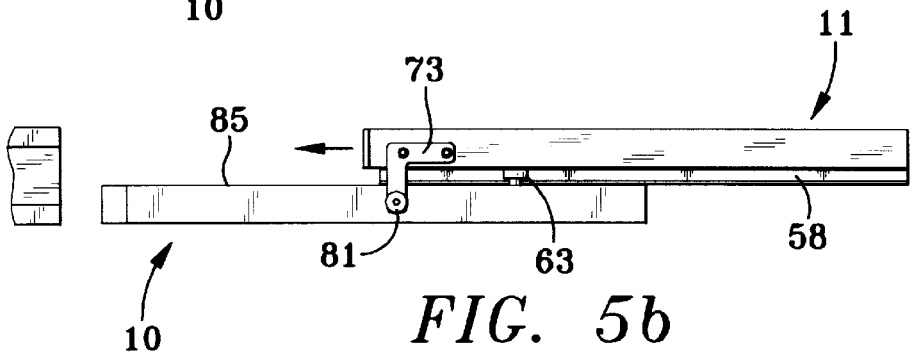
FIG. 5*b* is a view similar to that of FIG. 5*a* showing the panels sliding relative to one another.

As shown in FIG. 2, a channel 85 is positioned in the bottom of the left frame 16. The wheel 81 is received within this channel 85. Thus, as illustrated in FIGS. 5*a* and 5*b* (and note that these FIGS. 5*a*–5*d* are a bottom view), the pivot assembly 70 moves with the right panel as the right panel 11 slides relative to left panel 10. (The channel plate 75 is omitted from FIGS. 5*b*–5*c* for ease of illustration.) As illustrated in FIGS. 3 and 4, the wheel 81 slides in the channel 85 at the bottom of the left frame 16, as the wheel assemblies 43, 44 of the carrier bar 39 slide in the channel 31 formed in the header 30, at the top of the panels.

Figure 5C:
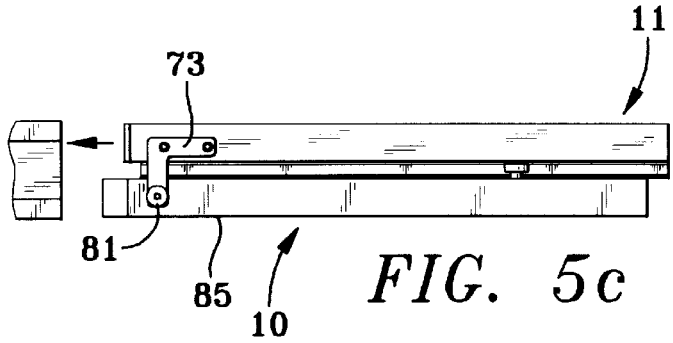
FIG. 5*c* is a view similar to that of FIG. 5*a* showing the panels slid fully open relative to one another (full overlap)
Figure 5D:
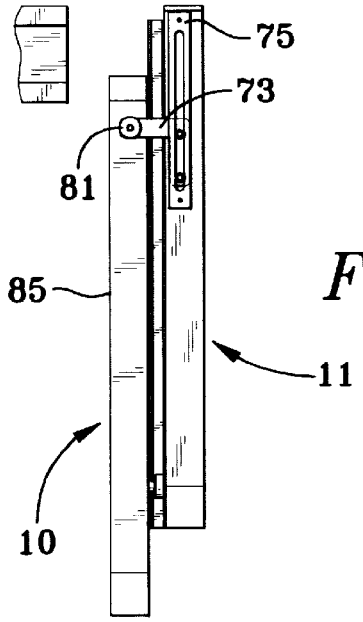
FIG. 5*d* is a view similar to that of FIG. 5*a* showing the panels swung fully open.

FIGS. 5*c* and 5*d* illustrate the floating pivot assembly 70 when the panels 10, 11 are placed in the swinging mode of operation. The wheel 81 forms the bottom pivot point for the right panel 11, when both panels 10, 11 are in the swinging mode. Wheel 81 moves within the channel 85 while L-shaped pivot plate 73 slides in the channel 76 in the slide channel unit 72, as the panel 11 pivots about the wheel 81. The floating pivot assembly 70 permits the panels to swing together in a confined space as the left panel 10 swings on pivots 19 and 27 and as the right panel 11 swings on its pivot: the wheel 81. The floating pivot assembly 70 compensates and adjusts for the motion of the right panel 11 as its nose passes that of the left panel 10 (note movement of base plate 73 relative to channel plate 75 shown in FIG. 5*d*) as both panels 10, 11 swing so that the doorway is fully open.

Since spacing is maintained by the floating pivot assembly 70 and the guide roller 62 in combination with the guide bar 58, "finger pinch" is prevented in the space between the overlapped panel ends. Sagging of the panel 11 is prevented because the weight of the panel 11 is transferred to the guide roller 62 via the guide bar 58 once the panel 1I1 is released from carrier bar 39. The need for a pivot mounted to the floor for a panel, as in the prior art, is eliminated, with the attendant trip hazard that such a floor mounted point would entail, because the pivots for the panels are either positioned in the door frame or concealed within the panels themselves. The need for a track mounted to the floor for a sliding panel, as in the prior art, is also eliminated, with the trip hazard associated with such a track, because the sliding panel slides on tracks located at the top of the opening and in the bottom of the first panel.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. A sliding and swinging closure structure comprising:

a pair of panels including a first panel having means for mounting said first panel in an opening for pivoting said first panel open and closed in a swinging mode of operation, and a second panel, said second panel being adapted to slide relative to said first panel by a first track means positioned along the top of said opening on which said second panel slides relative to said first panel between a closed position of the structure when said first panel and said second panel are extended relative to one another and a slid open position when said first panel and said second panel are substantially overlapped, said second panel being adapted to pivot about a vertical axis which travels with said second panel in said swinging mode of operation, and including a top pivot mount assembly between said first and second panels, a pivot mounting provided along a section of the bottom of said second panel, a first channel formed in said pivot mounting, a guide mounted within said first channel, said guide being adapted to slide in said first channel, an arm extending from said guide, said arm having a pivot member extending therefrom, a second track means formed along the bottom of said first panel within which said pivot member is slidably received for movement therein, a guide bar positioned on a section of the top of said second panel, said guide bar having a second channel, a support member carried on said first panel, said support member being slidably received in said second channel of said guide bar, said support member supporting said second panel in said swinging mode of operation, and means for releasably engaging said panels for relative sliding movement in a sliding mode of operation, said releasably engaging means further disengaging when in said swinging mode of operation.

2. A sliding and swinging closure structure for an opening comprising:

at least one pair of panels including a first panel having means for mounting said first panel in an opening, said means for mounting including a first pivot assembly positioned at the bottom of said first panel and a second pivot assembly at the top of said first panel for pivoting said first panel open and closed in a swinging mode of operation, and a second panel, said second panel mounted to slide relative to said first panel between a closed position when said first and second panels are extended relative to one another to a slid open position when said first and second panels are substantially overlapped, said second panel being further mounted to pivot about a vertical axis which travels with said second panel in said swinging mode of operation, a first track means mounted along the top of said opening, at least one wheel assembly positioned along the top of said second panel, said wheel assembly engaging with said first track means to allow said second panel to slide relative to said first panel, a pivot mounting provided along a section of the bottom of said second panel, a first channel formed in said pivot mounting, a guide mounted within said first channel, said guide being adapted to slide in said first channel, an arm extending from said guide, said arm having a wheel mounted thereon, a second track means positioned in the bottom of said first panel, said wheel of said arm being received in said second track means of said first panel as said second panel slides relative to said first panel, said wheel being a pivot point about which said second panel pivots as said panels are in said swinging mode of operation, a first bar mounted along said wheel assembly, a second bar positioned along the top of said second panel, said first and second bars engaging through an overlapping flange connection along a length of both of said bars, and a stop bar positioned along a section of the top of said opening and located to prevent said swinging mode of operation until said panels are substantially overlapped.

3. The sliding and swinging closure structure of claim 2 wherein said first and second bars engage through said overlapping flange connection along the length of both of said bars, and maintain said second panel in said opening until said panels are substantially overlapped in said swinging mode of operation, said first and second bars releasably disengaging from the overlapping flange connection when said panels are in said swinging mode of operation.

4. The sliding and swinging closure structure of claim 2 wherein said first bar abuts said stop bar from said closed position to said slid open position to maintain said second panel in said opening as said second panel slides from said fully closed position to said slid open position wherein said second panel may engage in said swinging mode of operation only when said first bar is slid beyond said stop bar, when said panels are in said slid open position.

5. A sliding and swinging closure structure for an opening comprising:

at least one pair of panels including a first panel mounted in an opening, said mount including a first pivot assembly positioned at the bottom of said first panel and a second pivot assembly positioned at the top of said first panel for pivoting said first panel open and closed in a swinging mode of operation, and a second panel, said second panel mounted to slide relative to said first panel between a closed position of the structure when said first and second panels are extended relative to one another to a slid open position when said first and second panels are substantially overlapped, a header in the top of said opening, a first track formed in said header, at least one wheel assembly carried on a carrier bar adjacent the top of said second panel, said wheel assembly engaging said carrier bar with said track to allow said second panel to slide relative to said first panel, a mounting block mounted along a section of the bottom of said second panel, a first plate mounted to the bottom of said mounting block, a first channel formed in said first plate, a second plate received for sliding movement in said first channel, a wheel mounted to said second plate, a second track positioned in the bottom of said first panel, said wheel of said second plate being received in said second track for sliding movement relative to said first panel, said wheel being a pivot point about which said second panel pivots, a torsion bar positioned within said second panel, said torsion bar rotatably engaged with said carrier bar, said second panel further pivoting about said torsion bar, said carrier bar further engaging with a mounting bar fixed to said second panel through an overlapping flange connection along a length of both of said carrier and mounting bars, said carrier and mounting bars releasably disengaging when said panels are in said swinging mode of operation, a stop bar positioned along a section of the top of said header, said carrier bar abutting said stop bar from said fully closed position to said slid open position such that said second panel is maintained in said opening as said second panel slides from said fully closed position to said slid open position, such that when said second panel is slid beyond said stop bar, said first and second panels can then be rotated as a unit in said swinging mode of operation.

6. An assembly for pivoting and sliding movement of a pair of panels, comprising:

a pair of panels including a first panel and a second panel;

a mounting mechanism for mounting said second panel for sliding movement relative to said first panel in a sliding mode of operation, said panels further being overlapped through said sliding movement for a swinging mode of operation, said mounting mechanism being located adjacent the top of an opening within which said panels are moved to open and close said opening;

a first pivot device carried by said second panel for pivoting movement of said second panel in said swinging mode of operation, said first pivot device being engaged with said mounting mechanism;

a second pivot device for said second panel, said second pivot device having a first channel formed along a section of said second panel spaced from said first pivot device, said first channel extending generally parallel to the direction of travel of said second panel in said sliding movement, a guide slidably mounted within said first channel, a pivot member mounted on said guide and extending therefrom, and a pivot track formed along a section of said first panel within which said pivot member is slidably received.

7. The assembly of claim 6 wherein said mounting mechanism includes a mounting bar on a section of one of the top of said opening and said second panel, and a slide assembly carried in a slide track on the other of the top of said opening and said second panel, said slide assembly having a first flange member thereon which engages with a second flange member on said mounting bar when in said sliding mode of operation, and disengaging therefrom in said swinging mode of operation, and further including a support member carried on one of said first and second panels, said support member being slidably received in a guide bar channel on the other of said first and second panels, said support member and guide bar channel combining to support said second panel on said first panel in said swinging mode of operation.

8. The assembly of claim 7 wherein said first pivot device is a pintle element carried by said second panel and extending along a vertical axis, said pintle element further being engaged with a part of said mounting mechanism that remains on a section of one of the top of said opening in said swinging mode of operation, and said second pivot device has said first channel formed along a bottom section of said second panel, said guide further having an arm extending therefrom toward said first panel with said pivot member mounted on said arm of said guide, said pivot track being formed along a bottom section of said first panel.

9. The assembly of claim 8 wherein said guide of said second pivot device comprises a bracket with said arm extending from said bracket, said pivot member comprises a wheel carried on said arm, said wheel having an axis of rotation parallel to said vertical axis, said bracket being mounted to a carriage plate, said carriage plate being mounted for sliding within a channel of a slide plate that comprises said first channel, and said pivot track comprises an elongated channel member along the bottom of said first panel forming a race for said wheel.

10. A sliding and swinging closure for an opening defined in a building, such as a door opening, comprising:

a pair of panels including a first panel and a second panel;

a mounting device for mounting said first panel in the opening for pivoting movement of said first panel about a first panel pivot axis;

a mounting mechanism for mounting said second panel for sliding movement relative to said first panel in a sliding mode of operation, said panels further being overlapped through said sliding movement for a swinging mode of operation wherein both said panels swing as a unit about said first panel pivot axis, said mounting mechanism being located along the top of the opening;

a first pivot device carried by said second panel for movement of said second panel relative to said first panel in said swinging mode of operation, said first pivot device being connected to said mounting mechanism; and a second pivot device for said second panel, said second pivot device having a first channel formed along a section of said second panel spaced from said first pivot device, said first channel extending generally parallel to the direction of travel of said second panel in said sliding movement, a guide slidably mounted within said first channel, a pivot member mounted on said guide and extending therefrom, and a pivot track formed along a section of said first panel within which said pivot member is slidably received.

11. The closure of claim 10 wherein said mounting mechanism includes a mounting bar on said second panel, and a slide assembly carried in a slide track in said opening, said slide assembly having a first flange member thereon which engages with a second flange member on said mounting bar when in said sliding mode of operation, and disengaging therefrom in said swinging mode of operation, and further including a support member carried on said first panel, said support member being slidably received in a guide bar channel on said second panel, said support member and support member channel combining to support said second panel on said first panel in said swinging mode of operation.

12. The closure of 11 wherein said first pivot device is a torsion bar carried by said second panel and extending along a vertical axis, said torsion bar further being rotatably connected to a part of said mounting mechanism that remains on a section of the top of said opening in said swinging mode of operation, and said second pivot device has said first channel formed along a bottom section of said second panel, said guide further having an arm extending therefrom toward said first panel with said pivot member mounted on said arm of said guide, said pivot track being formed along a bottom section of said first panel.

13. The closure of claim 12 wherein said guide of said second pivot device comprises a bracket with said arm extending from said bracket, said pivot member comprising a wheel carried on said arm, said wheel having an axis of rotation parallel to said vertical axis, said bracket being mounted to a carriage plate, said carriage plate being mounted for sliding within a channel of a slide plate that comprises said first channel, and said pivot track comprises an elongated channel member along the bottom of said first panel forming a race for said wheel.

14. A closure structure comprising:

a pair of panels including a first panel, a mount for said first panel in an opening defined in a structure within which said panels are received, and a second panel, said second panel being adapted to slide relative to said first panel through use of a mounting mechanism having a first track positioned along the top of said opening on which said second panel slides relative to said first panel between a closed position of the opening when said first panel and said second panel are extended relative to one another and a slid open position when said first panel and said second panel are substantially overlapped, said second panel being adapted to pivot about a pivot device which travels with said second panel in a swinging mode of operation and is rotatably connected to a part of said mounting mechanism, and including a top pivot mount assembly for said second panel;

a pivot mounting along a section of the bottom of said second panel;

a first channel formed in said pivot mounting;

a guide mounted within said first channel, said guide being adapted to slide in said first channel;

an arm extending from said guide, said arm having a pivot member extending therefrom; and a second track formed along the bottom of said first panel within which said pivot member is received for movement thereon.

15. The closure of claim 14 further including a guide bar positioned on a section of the top of said second panel, said guide bar having a guide bar channel, a support member carried on said first panel, said support member being slidably received in said channel of said guide bar, said support member supporting said second panel in said swinging mode of operation, and means for releasably engaging said panels for relative sliding movement in said sliding mode of operation, said releasably engaging means further disengaging when in said swinging mode of operation.

16. The closure of claim 15 wherein said mounting mechanism further includes at least one wheel assembly positioned along the top of said second panel, said wheel assembly engaging with said first track means to allow said second panel to slide relative to said first panel; and said arm has a wheel mounted thereon, said wheel of said arm being received in said second track means of said first panel as said second panel slides relative to said first panel, said wheel being a pivot point about which said second panel pivots as said panels are in said swinging mode of operation.

17. The closure of claim 16 wherein said means for releasably engaging said panels includes first and second bars that engage through an overlapping flange connection along the length of both of said bars and maintain said second panel in said opening until said panels are in said swinging mode of operation, said first and second bars releasably disengaging from the overlapping flange connection when said panels are in said swinging mode of operation, and wherein a stop bar is located to abut against said first bar when said second panel moves from said closed position to said slid open position to maintain said second panel in said opening as said second panel slides from said fully closed position to said slid open position, whereby said second panel may engage in said swinging mode of operation only when said first bar is slid beyond said stop bar when said panels are in said slid open position.

18. A closure for a door opening comprising:

a pair of panels including a first panel, a mount for said first panel in the opening within which said panels are received, and a second panel, said second panel being adapted to slide relative to said first panel through use of a mounting mechanism having a first track positioned along the top of said opening on which said second panel slides relative to said first panel between a closed position of the opening when said first panel and said second panel are extended relative to one another and a slid open position when said first panel and said second panel are substantially overlapped, said second panel being adapted to pivot about a vertical axis which travels with said second panel in a swinging mode of operation, and including a top pivot mount assembly for said second panel;

a header in the top of said opening, said first track formed in said header;

a wheel assembly adjacent the top of said second panel, said wheel assembly having a carrier bar which engages with said track to allow said second panel to slide relative to said first panel;

a support member carried on said first panel, said support member slidably received in a channel of a guide bar mounted to said second panel, said guide bar and support member combining to support said second panel on said first panel in said swinging mode of operation;

a floating pivot comprising a first plate mounted to the bottom of said second panel, a first channel formed in said first plate, a second plate received for sliding movement in said first channel, said second plate having an arm extending therefrom toward said first panel, a wheel mounted to said arm of said second plate, a second track positioned in the bottom of said first panel, said wheel of said second plate being received in said second track for sliding movement relative to said first panel, said wheel being a pivot point about which said second panel pivots when said panels are in said swinging mode of operation, said floating pivot serving to permit said panels to move relative to one another in said swinging mode of operation and with said guide bar substantially maintaining the relative spacing between said doors in said overlapped condition;

a torsion bar positioned within said second panel, said torsion bar being rotatably engaged with said carrier bar, said second panel further pivoting about said torsion bar, said wheel assembly further having said carrier bar engaging with a mounting bar fixed to said second panel, said engagement of said carrier bar and said mounting bar being through an overlapping flange connection along a length of both of said carrier and mounting bars, said carrier and mounting bars releasably disengaging when said panels are in said swinging mode of operation; and a stop bar positioned along a section of the top of said header, said carrier bar abutting said stop bar from said fully closed position to said slid open position such that said second panel is maintained in said opening as said second panel slides from said fully closed position to said slid open position, such that when said second panel is slid beyond said stop bar, said first and second panels can then be rotated as a unit in said swinging mode of operation.

* * * * *